United States Patent [19]

Berryer

[11] Patent Number: 5,036,790

[45] Date of Patent: Aug. 6, 1991

[54] BOAT HULL CONSTRUCTION

[75] Inventor: Michel Berryer, Cadillac, Mich.

[73] Assignee: Outboard Marine Corporation, Waukegan, Ill.

[21] Appl. No.: 402,888

[22] Filed: Sep. 5, 1989

[51] Int. Cl.[5] ..... B63B 3/00

[52] U.S. Cl. ..... 114/358; 114/82; 114/83; 114/88; 144/136 C

[58] Field of Search ..... 114/355, 358, 359, 65 R, 114/79 R, 79 W, 80, 82, 83, 85, 87, 88; 144/136 R, 136 C

[56] References Cited

U.S. PATENT DOCUMENTS

| | | | |
|---|---|---|---|
| 20,308 | 5/1858 | Thompson, Jr. . | |
| 1,195,727 | 8/1916 | Ranco . | |
| 1,258,728 | 4/1918 | Wilcox . | |
| 1,259,572 | 4/1918 | Wilcox . | |
| 1,436,418 | 11/1922 | Ward . | |
| 1,461,376 | 7/1923 | Bartlett | 144/136 C |
| 1,689,304 | 1/1929 | Herreshoff . | |
| 1,740,846 | 12/1929 | Van Dusen . | |
| 1,831,479 | 11/1931 | Bryant | 114/79 R |
| 1,970,913 | 8/1934 | Kennaugh | 114/79 R |
| 2,224,482 | 12/1940 | Lee . | |
| 2,243,372 | 5/1941 | Chlopicki . | |
| 2,392,834 | 1/1946 | Clement, Jr. . | |
| 2,412,578 | 12/1946 | Harris | 114/83 |
| 2,437,509 | 3/1948 | Dawson | 114/85 |
| 2,662,237 | 12/1953 | Carey . | |
| 2,714,408 | 8/1955 | Pedersen | 144/136 C |
| 2,771,104 | 11/1956 | Saxe | 144/136 C |
| 2,941,216 | 6/1960 | Carlson . | |
| 3,034,549 | 5/1962 | Quackenbush | 144/136 C |
| 3,092,850 | 6/1963 | Klopstock et al. . | |
| 3,126,557 | 4/1964 | Stevens . | |
| 4,508,047 | 4/1985 | Bordat | 114/88 |
| 4,568,299 | 2/1986 | Montgomery . | |

FOREIGN PATENT DOCUMENTS

| | | | |
|---|---|---|---|
| 824211 | 2/1938 | France . | |
| 702752 | 3/1966 | Italy . | |
| 53640 | 3/1934 | Norway | 114/85 |
| 470564 | 8/1937 | United Kingdom . | |

*Primary Examiner*—Sherman D. Basinger
*Assistant Examiner*—Stephen P. Avila
*Attorney, Agent, or Firm*—Michael, Best & Friedrich

[57] ABSTRACT

Disclosed herein is a boat hull including a stringer member having an end surface including therein a cut-out, and a projection extending beyond the end surface, a bulkhead member extending transversely to the stringer member, fixed thereto, and including an end surface extending in coplanar relation to the end surface of the stringer member and including therein a cut-out, and a projection extending beyond the end surface of the bulkhead member, a deck member engaging the end surfaces of the stringer member and the bulkhead member and including cut-outs respectively receiving the projections on the stringer and bulkhead members, and a gusset member extending substantially at a right angle to the stringer and bulkhead members and including a first projection received in the cut-out in the stringer member and a second projection received in the cut-out in the bulkhead member.

21 Claims, 2 Drawing Sheets

BOAT HULL CONSTRUCTION

BACKGROUND OF THE INVENTION

1. Field of the Invention

The invention relates generally to boat hull constructions and more particularly to interior boat frames within the outer skin of a boat hull. Still more particularly the invention relates to rigidification of such boat frames.

2. Reference to Prior Art

Attention is directed to the following U.S. Pat. Nos.:

| | | |
|---|---|---|
| 020,308 | N. Thompson, Jr. | May 18, 1858 |
| 833,511 | B. C. Dean | October 16, 1906 |
| 1,195,727 | J. Ranco | August 22, 1916 |
| 1,258,728 | U. Wilcox | May 12, 1918 |
| 1,259,572 | U. Wilcox | May 19, 1918 |
| 1,436,418 | C. A. Ward | November 21, 1922 |
| 1,698,304 | L. F. Herreshoff | April 11, 1928 |
| 1,740,846 | C. A. Van Dusen | May 15, 1926 |
| 2,227,482 | J. Lee | October 11, 1938 |
| 2,243,372 | J. Chlopicki | December 2, 1939 |
| 2,392,834 | C. H. Clement, Jr. | January 15, 1946 |
| 2,662,237 | H. C. Carey | December 15, 1953 |
| 2,941,216 | W. T. Carlson | June 21, 1960 |
| 3,092,850 | Klopstock, et al. | June 11, 1963 |
| 3,126,557 | J. H. Stevens | March 31, 1964 |
| 4,568,299 | A. C. Montgomery | February 4, 1986 |

Attention is also directed to the following foreign patents:

| | |
|---|---|
| 470,564 | Great Britain |
| 824,211 | France |
| 702,752 | Italy |

SUMMARY OF THE INVENTION

The invention provides a boat hull including a stringer member including therein a cut-out, a bulkhead member extending transversely to the stringer member, fixed thereto, and including therein a cut-out, and a gusset member including a first projection received in the cut-out in the stringer member and a second projection received in the cut-out in the bulkhead member.

In one embodiment of the invention, the stringer member includes an end surface and a projection extending above the end surface, the bulkhead member includes an end surface co-planar with the end surface of the stringer member and a projection extending above the end surface of the bulkhead member, and the boat hull further includes a deck member engaging the end surfaces of the stringer and the bulkhead members and including therein cut-outs respectively receiving the projections on the stringer and bulkhead members.

The invention also provides a boat hull including a stringer member having an end surface, a bulkhead member extending transversely to the stringer member, fixed thereto, and including an end surface in coplanar relation to the end surface of the stringer member, a projection extending beyond one of the end surfaces, and a deck member engaging the end surfaces of the stringer member and the bulkhead member and including a cut-out receiving the projection.

The invention also provides a boat hull including a stringer member having an end surface including therein a cut-out, and a projection extending beyond the end surface, a bulkhead member extending transversely to the stringer member, fixed thereto, and including an end surface extending in coplanar relation to the end surface of the stringer member and including therein a cut-out, and a projection extending beyond the end surface of the bulkhead member, a deck member engaging the end surfaces of the stringer member and the bulkhead member and including cut-outs respectively receiving the projections extending from the stringer and bulkhead members, and a gusset member extending substantially at a right angle to the stringer and bulkhead members and including a first projection received in the cut-out in the stringer member and a second projection received in the cut-out in the bulkhead member.

The invention also provides a method of creating a planar frame member for a boat hull, which method comprises the steps of initiating rotation of a cutting tool, locating the tool in extending relation above and below the frame member, and moving the tool in the plane of the frame member while continuing rotation of the tool.

The invention also provides a method of forming a slot interiorly of the periphery of a planar frame member for a boat hull, which method comprises the steps of initiating rotation of a cutting tool, piercing the frame member with the rotating tool at a location inwardly of the periphery of the frame member, moving the rotating tool in the plane of the frame member for a predetermined distance equal to the length of a tang to be received in the slot, and thereafter withdrawing the rotating tool from the frame member.

The invention also provides a method of forming a slot in the periphery of a planar frame member for a boat hull, which method comprises the steps of initiating rotation of a cutting tool, locating the rotating tool in extending relation above and below the frame member, moving the rotating tool in the plane of the frame member and at about a right angle to the periphery for a distance equal to about the depth of the slot plus the diameter of the tool, thereafter moving the rotating tool in the plane of the frame member and in the opposite direction for a distance equal to about the diameter of the tool, thereafter moving the rotating tool in the plane of the frame member and parallel to the periphery for a distance equal to about the length of the slot, less the diameter of the tool, thereafter moving the rotating tool in the plane of the frame member and perpendicularly to and away from the periphery for a distance equal to one half the diameter of the tool, and thereafter moving the rotating tool in the opposite direction toward the periphery at least until the tool diameter passes outwardly of the periphery.

The invention also provides a method of forming a tang extending from the peripheral surface of a planar frame member for a boat hull, which method comprises the steps of initiating rotation of a cutting tool, locating the rotating tool in extending relation above and below the frame member, moving the rotating tool in the plane of the frame member and in a direction to produce the peripheral surface, thereafter moving the rotating tool in the plane of the frame member and in a direction generally at a right angle to the peripheral surface for a distance equal to about one-half the diameter of the tool, thereafter moving the rotating tool in the plane of the frame member and in the reverse direction for a distance about equal to the height of the tang plus one-half of the diameter of the tool, thereafter moving the rotating tool in the plane of the frame member in a direction generally parallel to the peripheral surface for a distance equal to about the width of the tang plus the diameter of the tool, thereafter moving the rotating tool in the plane of the frame member and in a direction generally at a right angle and toward the peripheral surface for a distance of about the height of the tang plus one half of the diameter of the tool, thereafter moving the rotating tool in the plane of the frame member and in the opposite direction for a distance of about one-half the diameter of the tool, and thereafter moving the rotating tool in the plane of the frame member and generally a right angle to the previous cut to continue producing the peripheral surface.

The invention also provides a frame member for a boat hull, which frame member is formed of sheet material and has a perimeter, and a slot located in spaced relation inwardly from the perimeter and including two parallel side edge surfaces, and two semi-cylindrical surfaces.

The invention also provides a frame member for a boat hull, which frame member is formed of sheet material, has first and second spaced peripheral surfaces having respective first and second ends in adjacently spaced relation, and has a tang defined by first and second side surfaces respectively extending outwardly from the first and second peripheral surfaces, by an outer surface connecting the first and second side surfaces, by a first semi-cylindrical surface having one end tangent to the first side surface of the tang and a second end extending at about a right angle to the first end of the first peripheral surface, and by a second semi-cylindrical surface having one end tangent to the second side surface of the tang and a second end extending at about a right angle to the second end of the second peripheral surface.

The invention also provides a frame member for a boat hull, which frame member includes first and second peripheral surfaces located in spaced relation to each other and having adjacent first and second ends spaced at a predetermined distance, a slot extending inwardly of the peripheral surfaces and defined by first and second side surfaces respectively extending at about a right angle from the first and second ends of the first and second peripheral surfaces and for a distance about equal to the depth of the slot, by a bottom surface extending generally parallel to the first and second peripheral surfaces and having first and second ends spaced at a distance less than the distance between the side surfaces, by a first semi-cylindrical surface having a first end extending tangently from the first side surface and a second end extending at about a right angle from the first end of the bottom surface, and by a second semi-cylindrical surface having a first end extending tangently from the second side surface and a second end extending at about a right angle from the second end of the bottom surface.

Other features and advantages of the invention will become apparent to those skilled in the art upon review of the following detailed description, claims, and drawings.

DRAWINGS

Figure 1:
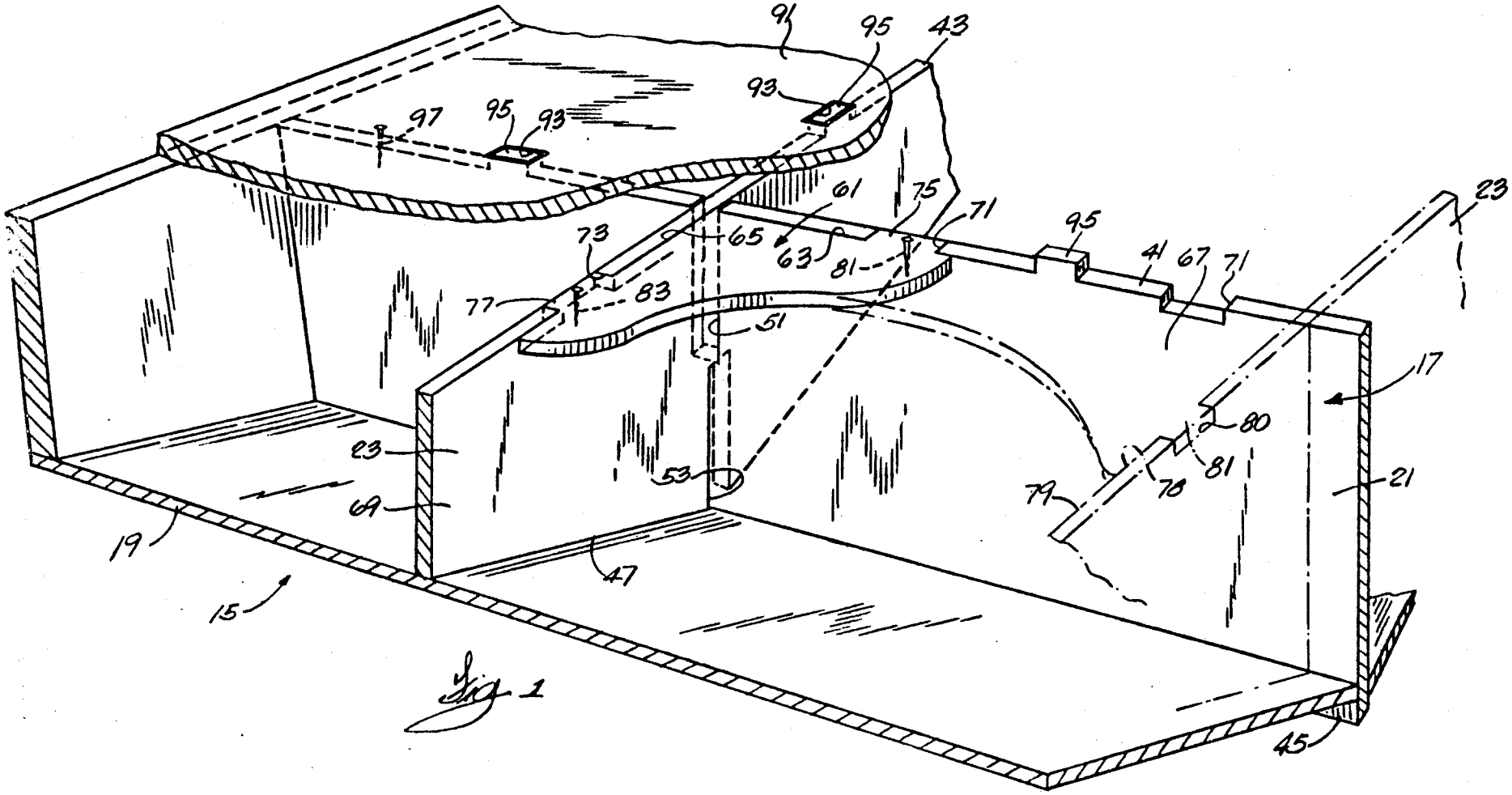
FIG. 1 is a fragmentary view, partially in section and partially cut-away, of a portion of a boat hull incorporating various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown fragmentarily in the drawings is a boat hull 15 including an inner boat frame 17 which supports or reinforces an outer skin or covering 19 which can be of fiberglass, or wood, or other suitable material. Preferably the boat frame 17 is of wood but other suitable materials can be employed.

The boat frame 17 includes one or more stringer members 21 extending fore and aft and one or more bulkhead members 23 extending transversely or from side to side of the boat hull 15. The bulkhead and stringer members 21 and 23 are preferably fabricated of wood planks or plywood. While any suitable number of stringer members or bulkhead members 23 can be employed, only one such bulkhead member 23 and one such stringer member 21 are shown in full line in FIG. 1.

The bulkhead members 23 can be fixed to the stringer members 21 in any suitable manner. In the preferred construction, the bulkhead members 23 are attached or fixed to the stringer members 21 by respective notch means which are formed in the members 21 and 23 and which mutually receive unnotched portions of the cooperating frame members 21 and 23.

More particularly, and while other constructions can be employed, in the disclosed construction, the stringer and bulkhead members 21 and 23 respectively include upper end surfaces 41 and 43 and lower end surfaces 45 and 47. Still more particularly, the upper end surface 41 of the stringer member 21 is provided with a notch 51 having a width slightly greater than the width of the bulkhead member 23, which notch 51 extends from the upper end surface 41 for one half, or slightly more than one-half, of the height of the bulkhead member 21. In addition, the bulkhead member 23 includes a notch 53 having a width slightly greater than the width of the stringer member 21 and extending from the lower end surface 47 for one-half, or slightly more than one half, of the height of the bulkhead member 23. The stringer and bulkhead members 21 and 23, respectively, are located in mutually engaged relation in the slots or notches 51 and 53 as shown in the drawings. As shown, the stringer member 21 can also provide a keel extending below the bottom of the bulkhead member 23.

The engagement of the stringer and bulkhead members 21 and 23, respectively, can be strengthened by use of a gusset member 61 which can be fabricated of wood, such as plywood, and which has a first and second end surfaces 63 and 65, respectively, extending at right angles to each other and adapted to engage the adjacent respective face surfaces 67 and 69 of the stringer and bulkhead members 21 and 23, respectively. Still further, and in order to further rigidify the boat frame 17, the respective upper end surfaces 41 and 43 of the stringer and bulkhead members 21 and 23 are provided with respective cut-outs or recesses 71 and 73 which receive tabs or projections 75 and 77 extending respectively and integrally from the end surfaces 63 and 65 of the gusset member 61. The gusset members 61 can be fastened to the stringer and bulkhead members 21 and 23, respectively, by use of fasteners 81 and 83, such as nails, staples, or screws or the like, extending through the respective projections 75 and 77 and into the respective bodies of the stringer and bulkhead members 21 and 23, respectively.

Furthermore, more than one gusset member 61 can be employed and such additional gusset members can be assembled and fastened between one stringer member 21 and two bulkhead members 23 (as shown in dotted outline in the drawings), or between one bulkhead member 23 and two stringer members 21, by employing a third or additional end surface 78 parallel to one of the first mentioned end surfaces 63 and 65 and engaging the adjacent face 79 of the additional boat frame member, by providing an additional notch or recess 80 in the additional boat frame member, and by employing an additional projection or tab 81 extending from the additional end surface 78 and received in the additional notch 80.

Still further in addition, a gusset member having four end surfaces can be located and fixed within a box shaped area between two stringer and two bulkhead members. Still further in addition, a triangular shaped or other shaped gusset member can be employed to correspond to any open area between frame members which are to be rigidified. In such additional constructions, the gusset members are provided with suitable projections and the upper end surfaces of the frame members are notched or cut-out to receive the projections on the gusset members.

The boat frame 17 also includes a boat deck or floor member 91 which can be assembled to the stringer and bulkhead members 21 and 23, respectively. Such a deck or floor member 91 can be employed in addition to any gusset members 61, or without the use of gusset members 61. In this last regard, the upper end surfaces 41 and 43 of the stringer and bulkhead members 21 and 23, respectively, are located in co-planar relation, and means are provided for interlocking engagement between the deck or floor member 91 and one or both of the stringer and the bulkhead members 21 and 23, respectively. In the disclosed construction, such means comprises cut-outs or notches 93 in the floor or deck member 91 located in alignment with an underlying stringer or bulkhead member to which connection is desired, and a tab or projection 95 which extends upwardly from the applicable one of the end surfaces 41 and 43 of the underlying stringer or bulkhead member 21 or 23, respectively, to be connected and which is received in the cut-out 93. Preferably, the cut-outs 93 are only slightly larger than the projections or tabs 95 to provide stability in directions at right angles to each other.

If desired, the deck or floor member 91 and the underlying frame members 21 and 23 can be interengaged by any number of such cut-outs and projections 93 and 95, respectively, to assist in rigidifing the boat frame 17 and assembling the deck or floor member 91 to the underlying boat frame members 21 and 23.

If desired, the deck or floor member 91 can be fastened to the connected underlying frame members 21 and 23 by fasteners 97, such as nails, staples, or screws, extending through the deck or floor member 91 and into the underlying frame members 21 and 23 outwardly of the interengagement of the projections 95 in the slots or cut-outs 93. As already indicated, any number of interengagements between projections 95 and cut-outs 93 can be employed to stabilize and rigidify the deck member 91 to the underlying frame members 21 and 23 and to rigidify and fix the underlying frame members 21 and 23 relative to each other.

As already pointed out, in order to strengthen and rigidify the boat frame 17, gusset members 61 can also be employed in addition to the floor or deck member 91, or in place thereof in locations where a floor member is not appropriate.

Figure 2:
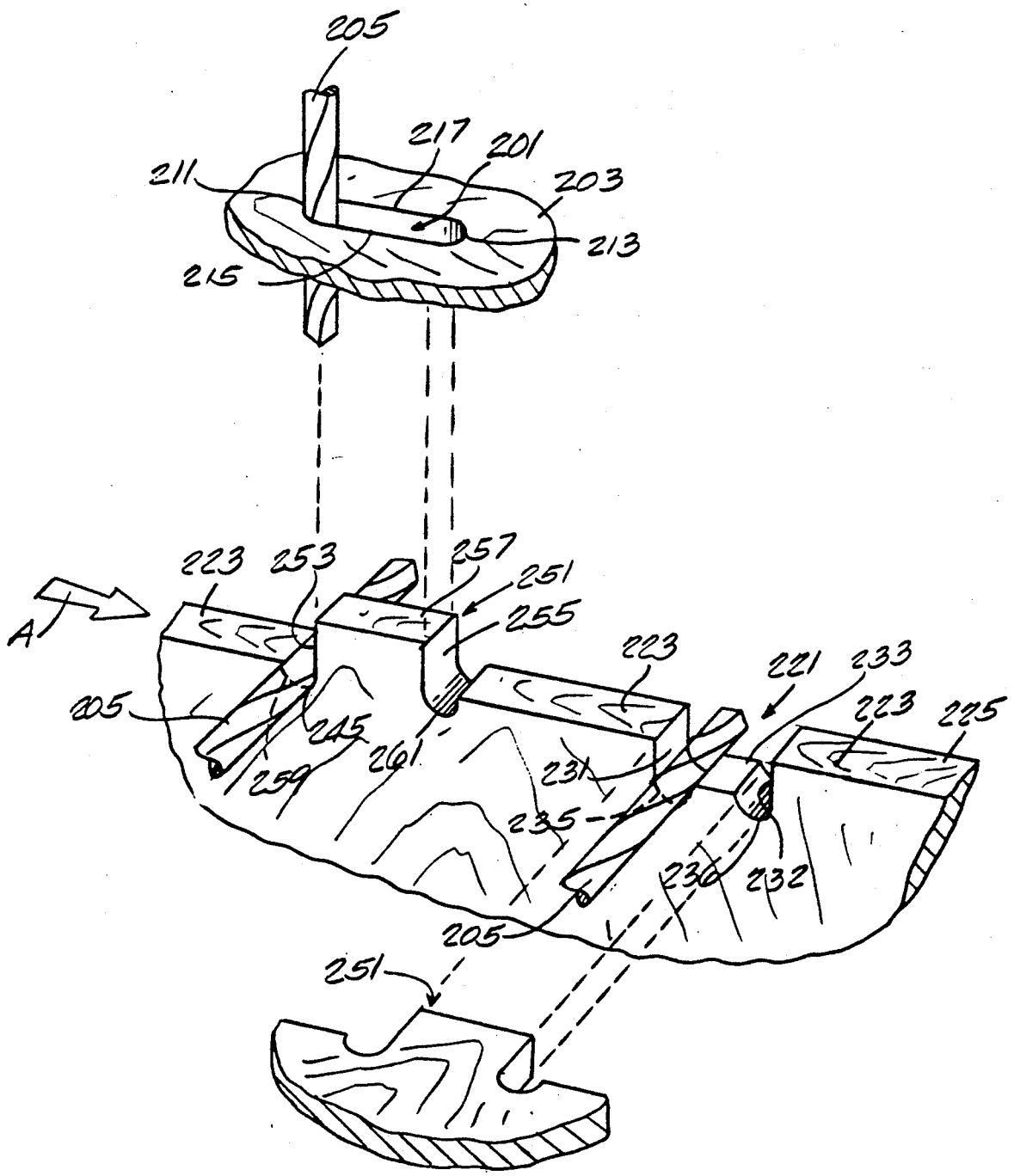
FIG. 2 is a fragmentary perspective view, illustrating methods incorporating various of the features of the invention.

Illustrated in FIG. 2 of the drawings is a method and for creating a frame member perimeter surface, slots and tangs. In this last regard, it is noted that the construction shown in FIG. 1 includes both tangs and slots associated with perimeter surfaces and interior slots spaced from the perimeter of a frame member.

In this last regard, and in accordance with the method, there is shown in FIG. 2, an interior slot 201 which is spaced from the perimeter or peripheral surface of a frame member 203 and which is provided by initiating rotation of a cutting tool 205, such as a drill or router bit, or any other device capable of cutting and removing a substance, such as wood, either in a vertical motion or in a horizontal motion, either independently or simultaneously, by piercing the frame member 203 with the rotating drill 205 at a location spaced inwardly of the perimeter or periphery of the frame member 203, by then moving the rotating drill 205 in the plane of the frame member 203 to cut the frame member 203 and to create the interior slot 201, and thereafter by withdrawing the drill from the frame member 203.

Still further in this last regard, the step of moving the rotating drill 205 in the plane of the frame member 203 involves rectilinear movement of the rotating drill 205 for a distance equal to the length of tang to be received to provide the elongated slot 201 with semi-circular ends 211 and 213 and parallel sides 215 and 217. It is noted that the diameter of the drill 205 is approximately the same as the thickness of the tang to be inserted into the slot 201. The overall length of the resulting interior slot 201 is equal to the length of the tang to be received, plus the diameter of the drill 205.

Also shown in FIG. 2 is a peripheral slot 221 which is located on a periphery or peripheral surface 223 of a frame member 225 of plywood or other suitable sheet material and which is produced, during translatory movement of the rotating drill 205 in the plane of the frame member 225, either as part of a cut defining the peripheral surface 223 or as an operation independent from a pre-existing peripheral surface 223, by the steps of moving the rotating drill 205 at a right angle to the peripheral surface 223 for a distance equal to the thickness of the tang to be received, plus the diameter of the drill. Thereafter, the rotating drill 205 is moved in the reverse direction for a distance equal to the diameter of the drill. Thereafter, the rotating drill 205 is moved in the direction parallel to the peripheral surface 223 for a distance about equal to the length of the tang to be received in the slot, minus the diameter of the drill 205. Thereafter, the rotating drill 205 is moved at about a right angle to the prior cut for a distance of one-half the diameter of the drill. Thereafter the rotating drill 205 is moved in the reverse direction for a distance equal to the thickness of the tang to be received. Thereafter, if the operation also is producing the peripheral surface 223, the rotating drill 205 can again be moved in the plane of the frame member 225 and in a direction to continue to produce the peripheral surface 223.

The peripheral slot 221 is generally rectangular having two parallel short side edges or surfaces 231 and 232. The peripheral slot 221 is also defined by a long bottom edge or surface 233 located between and in a spaced relation to the side edges 231 and 232. In addition, the peripheral slot 221 includes, at each of the ends of the bottom surface 233, two semi-cylindrical surfaces 235 and 236 which, at the ends of the bottom surface extend at a right angle thereto, and which, at the short side surfaces 231 and 232 extend in tangential relation thereto.

Also shown in FIG. 2 is a peripheral tang 251 which is located at the periphery of the frame member 225 and which is created during movement of the drill 205 in the plane of the plywood frame member 225 and in the process of creating the peripheral surface 223. More specifically, the method includes initiating rotation of the drill 205, moving the rotating drill 205 in the plane of the frame member 225 and in the direction A to create or produce the peripheral surface 223, moving the rotating drill 205 at about a right angle to the just-cut peripheral surface 223 for a distance of about one half the diameter of the drill 205 until a semi-circular cut-out or notch 245 is provided, which notch 245 has a diameter extending in alignment with the peripheral surface 223. Thereafter, the rotating drill 205 is moved in the opposite direction i.e., at about a right angle to the peripheral surface 223, for a distance equal to the desired height of the tang 251, plus the diameter of the drill 205.

Thereafter, the rotating drill 205 is moved in the plane of the frame member 225 and in the direction parallel to the peripheral surface 223 and for a distance equal to the width of the tang 251, plus the diameter of the drill 205. Still further and thereafter, the rotating drill 205 is moved at about a right angle to the peripheral surface 223 and for a distance equal to the height of the tang 251, plus the diameter of the drill 205. Thereafter, the rotating drill 205 is moved in the opposite direction for a distance equal to one-half the diameter of the drill 205. Thereafter, the rotating drill 205 is again moved in the direction A to continue production of the peripheral surface 223 after having defined the tang 251.

The peripheral tangs 251 are rectangular, having a pair of side edges or surfaces 253 and 255 and an outer edge or surface 257. However, and in accordance with the method, the peripheral tangs 251, are also defined, at the inner ends of each of the side surfaces 253 and 255, by respective semi-cylindrical cut-outs or notches or surfaces 259 and 261 having one end tangent to the tang side surfaces 253 and 255 and an opposite end extending at about a right angle to the adjacent peripheral surface 223.

The frame members are thus made by moving the rotating drill 205 in the plane of the plywood or other suitable sheet material to fully or partially define the perimeter and to provide tangs 251 and slots 221 as desired along the perimeter of the frame members and to provide interior slots 201.

Various of the features of the invention set forth in the following claims.

I claim:

1. A boat hull including a stringer member including therein a cut-out, a bulkhead member extending transversely to said stringer member, fixed thereto, and including therein a cut-out, and a gusset member including a first projection received in said cut-out in said stringer member and a second projection received in said cut-out in said bulkhead member.

2. A boat hull in accordance with claim 1 wherein said stringer member includes an end surface and a projection extending above said end surface, wherein said bulkhead member includes an end surface co-planar with said end surface of said stringer member and a projection extending above said end surface of said bulkhead member, and further including a deck member engaging said end surfaces of said stringer and said bulkhead members and including therein cut-outs respectively receiving said projections on said stringer and bulkhead members.

3. A boat hull in accordance with claim 1 wherein said stringer and bulkhead members respectively include face surfaces, wherein said gusset member includes a first end surface engaging said face surface of said stringer member, and wherein said first projection extends beyond said first end surface, wherein said gusset member includes a second end surface engaging said face surface of said bulkhead member, and wherein said second projection extends beyond said second end surface.

4. A boat hull in accordance with claim 3 wherein said stringer member includes an end surface and said cut-out in said stringer member is in said end surface, and wherein said bulkhead member includes an end surface and said cut-out in said bulkhead member is in said end surface of said bulkhead member.

5. A boat hull in accordance with claim 3 wherein one of said stringer member and said bulkhead member includes a notch which extends inwardly from said end surface thereof and which receives the other of said stringer member and said bulkhead member, and wherein said other of said stringer member and said bulkhead member includes an opposite end surface spaced from said first mentioned end surface and a notch which extends from said opposite end surface and which receives said one of said stringer member and said bulkhead member.

6. A boat in accordance with claim 1 wherein said stringer member, said bulkhead member, and said gusset member form part of a boat frame and further including a skin covering at least a part of said boat frame.

7. A boat in accordance with claim 1 and further including first and second fastening means extending respectively through said first and second projections and respectively into said stringer and bulkhead members.

8. A boat hull including a stringer member having an end surface, a bulkhead member extending transversely to said stringer member, fixed thereto, and including an end surface in coplanar relation to said end surface of said stringer member, a projection extending beyond one of said end surfaces, and a deck member engaging said end surfaces of said stringer member and said bulkhead member and including a cut-out receiving said projection.

9. A boat in accordance with claim 8 and further including fastening means extending through said deck member and into said one end surface and in spaced relation to said projection.

10. A boat hull including a stringer member having an end surface including therein a cut-out, and a projection extending beyond said end surface, a bulkhead member extending transversely to said stringer member, fixed thereto, and including an end surface extending in coplanar relation to said end surface of said stringer member and including therein a cut-out, and a projection extending beyond said end surface of said bulkhead member, a deck member engaging said end surfaces of said stringer member and said bulkhead member and including cut-outs respectively receiving said projections extending from said stringer and bulkhead members, and a gusset member extending substantially at a right angle to said stringer and bulkhead members and including a first projection received in said cut-out in said stringer member and a second projection received in said cut-out in said bulkhead member.

11. A boat hull in accordance with claim 10 wherein said stringer and bulkhead members respectively include face surfaces, wherein said gusset member includes a first end surface engaging said face surface of said stringer member, and wherein said first projection extends beyond said first end surface, wherein said gusset member includes a second end surface engaging said face surface of said bulkhead member, and wherein said second projection extends beyond said second end surface.

12. A boat hull in accordance with claim 11 wherein said stringer member includes an end surface and said cut-out in said stringer member is in said end surface, and wherein said bulkhead member includes an end surface and said cut-out in said bulkhead member is in said end surface of said bulkhead member.

13. A boat hull in accordance with claim 11 wherein one of said stringer member and said bulkhead member includes a notch which extends inwardly from said end surface thereof and which receives the other of said stringer member and said bulkhead. member, and wherein said other of said stringer member and said bulkhead member includes an opposite end surface spaced from said first mentioned end surface and a notch which extends from said opposite end surface and which receives said one of said stringer member and said bulkhead member.

14. A boat in accordance with claim 10 wherein said stringer member, said bulkhead member, said deck member, and said gusset member form part of a boat frame and further including a skin covering at least a part of said boat frame.

15. A boat in accordance with claim 10 and further including first and second fastening means extending respectively through said first and second projections and respectively into said stringer and bulkhead members.

16. A boat in accordance with claim 10 and further including fastening means extending through said deck member and into said end surfaces of said stringer and bulkhead members and in spaced relation to said projections extending from said end surfaces.

17. A method of forming a slot in the periphery of a planar frame member for a boat hull, said method comprising the steps of initiating rotation of a cutting tool, locating the rotating tool in extending relation above and below the frame member, moving the rotating tool in the plane of the frame member and at about a right angle to the periphery for a distance equal to about the depth of the slot plus the diameter of the tool, thereafter moving the rotating tool in the plane of the frame member and in the opposite direction for a distance equal to about the diameter of the tool, thereafter moving the rotating tool in the plane of the frame member and parallel to the periphery for a distance equal to about the length of the slot, less the diameter of the tool, thereafter moving the rotating tool in the plane of the frame member and perpendicularly to and away from the periphery for a distance equal to one half the diameter of the tool, and thereafter moving the rotating tool in the opposite direction toward the periphery at least until the tool diameter passes outwardly of the periphery.

18. A method of forming a tang extending from the peripheral surface of a planar frame member for a boat hull, which method comprises the steps of initiating rotation of a cutting tool, locating the rotating tool in extending relation above and below the frame member, moving the rotating tool in the plane of the frame member and in a direction to produce the peripheral surface, thereafter moving the rotating tool in the plane of the frame member and in a direction generally at a right angle to the peripheral surface for a distance equal to about one-half the diameter of the tool, thereafter moving the rotating tool in the plane of the frame member and in the reverse direction for a distance about equal to the height of the tang plus one-half of the diameter of the tool, thereafter moving the rotating tool in the plane of the frame member and in a direction generally parallel to the peripheral surface for a distance equal to about the width of the tang plus the diameter of the tool, thereafter moving the rotating tool in the plane of the frame member and in a direction generally at a right angle and toward the peripheral surface for a distance of about the height of the tang plus one-half of the diameter of the tool, thereafter moving the rotating tool in the plane of the frame member and in the opposite direction for a distance of about one-half the diameter of the tool, and thereafter moving the rotating tool in the plane of the frame member and generally at a right angle to the previous cut to continue producing the peripheral surface.

19. A frame member for a boat hull, said frame member being formed of sheet material and having a perimeter, and a slot located in spaced relation inwardly from said perimeter and including two parallel side edge surfaces, and two semi-cylindrical surfaces.

20. A frame member for a boat hull, said frame member being formed of sheet material, having first and second spaced peripheral surfaces having respective first and second ends in adjacently spaced relation, and having a tang defined by first and second side surfaces respectively extending outwardly from said first and second peripheral surfaces, by an outer surface connecting said first and second side surfaces, by a first semi-cylindrical surface having one end tangent to said first side surface of said tang and a second end extending at about a right angle to said first end of said first peripheral surface, and by a second semi-cylindrical surface having one end tangent to said second side surface of said tang and a second end extending at about a right angle to said second end of said second peripheral surface.

21. A frame member for a boat hull, said frame member including first and second peripheral surfaces located in spaced relation to each other and having adjacent first and second ends spaced at a predetermined distance, a slot extending inwardly of said peripheral surfaces and defined by first and second side surfaces respectively extending at about a right angle from said first and second ends of said first and second peripheral surfaces and for a distance about equal to the depth of the slot, by a bottom surface extending generally parallel to said first and second peripheral surfaces and having first and second ends spaced at a distance less than the distance between said side surfaces, by a first semi-cylindrical surface having a first end extending tangently from said first side surface and a second end extending at about a right angle from said first end of said bottom surface, and by a second semi-cylindrical surface having a first end extending tangently from said second side surface and a second end extending at about a right angle from said second end of said bottom surface.

* * * * *